US009958232B1

(12) United States Patent
Egerdee et al.

(10) Patent No.: US 9,958,232 B1
(45) Date of Patent: May 1, 2018

(54) MECHANISM FOR DRAWING, COCKING, AND TRIGGERING A CROSSBOW

(71) Applicant: Excalibur Crossbow, Inc., Kitchener (CA)

(72) Inventors: Kyle William Egerdee, Fergus (CA); Stephen Donald Langdon, Arthur (CA); Benjamin Dean Blosser, Corydon, KY (US); Daniel Pierre Brassard, New Westminster (CA)

(73) Assignee: EXCALIBUR CROSSBOW, INC., Kitchener (CA)

( * ) Notice: Subject to any disclaimer, the term of this patent is extended or adjusted under 35 U.S.C. 154(b) by 0 days. days.

(21) Appl. No.: 15/784,138

(22) Filed: Oct. 15, 2017

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS

| | | | |
|---|---|---|---|
| 2,786,461 | A | 3/1957 | Pelsue |
| 3,043,287 | A | 7/1962 | Nelson |
| 3,561,419 | A | 2/1971 | Cucuzza |
| 3,670,711 | A | 6/1972 | Firestone |
| 4,593,675 | A | 6/1986 | Waiser |
| 4,603,676 | A | 8/1986 | Luoma |
| 4,649,892 | A | 3/1987 | Bozek |
| 4,697,571 | A | 10/1987 | Waiser |
| 4,719,897 | A | 1/1988 | Gaudreau |
| 4,942,861 | A | 7/1990 | Bozek |
| 5,085,200 | A | 2/1992 | Horton-Corcoran et al. |
| 5,115,795 | A | 5/1992 | Farris |
| 5,220,906 | A | 6/1993 | Choma |
| 5,598,829 | A | 2/1997 | Bednar |
| 5,649,520 | A | 7/1997 | Bednar |
| 5,823,172 | A | 10/1998 | Suggitt |
| 5,884,614 | A | 3/1999 | Darlington et al. |
| 6,095,128 | A | 8/2000 | Bednar |
| 6,205,990 | B1 | 9/2001 | Bednar |
| 6,736,123 | B1 | 5/2004 | Summers et al. |
| 6,799,566 | B1 | 10/2004 | Malucelli |
| 6,802,304 | B1 | 10/2004 | Chang |

(Continued)

*Primary Examiner* — John Ricci
(74) *Attorney, Agent, or Firm* — David S. Alavi

(57) ABSTRACT

An inventive mechanism includes stationary, reciprocating, winch, and stock subassemblies. The winch subassembly is mounted on the stock subassembly; the stationary subassembly is mounted at the rear of a slotted mainframe of the stock subassembly; the reciprocating subassembly moves along the mainframe between forward brace and rearward drawn positions. The winch subassembly takes up a rope to cause rearward movement of the reciprocating subassembly and lets out the rope to permit forward movement. The reciprocating subassembly includes a body engaged with the slot, a catch, and a sear. The stationary subassembly includes a trigger and an actuator. In the drawn position and retaining a bowstring, trigger movement causes actuator movement, which causes sear movement, which permits catch movement, which releases the bowstring. In its latched position, a trigger latch obstructs forward movement of the reciprocating subassembly from the drawn position; in its unlatched position, it permits that forward movement.

25 Claims, 11 Drawing Sheets

(56) References Cited

U.S. PATENT DOCUMENTS

| | | | |
|---|---|---|---|
| 6,913,007 | B2 | 7/2005 | Bednar |
| 7,100,590 | B2 | 9/2006 | Chang |
| 7,770,567 | B1 | 8/2010 | Yehle |
| 7,784,453 | B1 | 8/2010 | Yehle |
| 8,104,461 | B2 | 1/2012 | Kempf |
| 8,240,299 | B2 | 8/2012 | Kronengold et al. |
| 8,443,790 | B2 | 5/2013 | Pestrue |
| 8,453,631 | B1 | 6/2013 | Kronengold et al. |
| 8,499,753 | B2 | 8/2013 | Bednar et al. |
| 8,578,917 | B2 | 11/2013 | Bednar et al. |
| 8,899,217 | B2 | 12/2014 | Islas |
| 8,950,385 | B1 | 2/2015 | Khoshnood |
| 9,010,308 | B1 | 4/2015 | Hyde et al. |
| 9,140,516 | B1 | 9/2015 | Hyde |
| 9,303,944 | B2 | 4/2016 | Barber |
| 9,341,432 | B1 | 5/2016 | Wohleb |
| 9,341,434 | B2 | 5/2016 | McPherson et al. |
| 9,383,159 | B2 | 7/2016 | Pulkrabek et al. |
| 9,404,706 | B2 | 8/2016 | Khoshnood |
| 9,494,380 | B1 | 11/2016 | Yehle |
| 9,528,792 | B1 | 12/2016 | Chang |
| 2002/0059924 | A1 | 5/2002 | Bednar |
| 2004/0194771 | A1 | 10/2004 | Malucelli |
| 2005/0022799 | A1 | 2/2005 | Bednar |
| 2006/0086346 | A1 | 4/2006 | Middleton |
| 2006/0144380 | A1 | 7/2006 | Kempf |
| 2006/0169258 | A1 | 8/2006 | Chang |
| 2010/0170488 | A1 | 7/2010 | Rasor et al. |

MECHANISM FOR DRAWING, COCKING, AND TRIGGERING A CROSSBOW

FIELD OF THE INVENTION

The field of the present invention relates to crossbows. In particular, inventive mechanisms for drawing, cocking, and triggering a crossbow are disclosed.

BACKGROUND

A wide variety of crossbows have been disclosed previously; some of those are disclosed in:

U.S. Pat. No. 2,786,461 entitled "Cross bow pistol" issued Mar. 26, 1957 to Pelsue;

U.S. Pat. No. 3,043,287 entitled "Crossbow cocking device" issued Jul. 10, 1962 to Nelson;

U.S. Pat. No. 3,561,419 entitled "Cross bow with pneumatic cooking assembly" issued Feb. 9, 1971 to Cucuzza;

U.S. Pat. No. 3,670,711 entitled "Crossbow cocking device" issued Jun. 20, 1972 to Firestone;

U.S. Pat. No. 4,593,675 entitled "Cross bows" issued Jun. 10, 1986 to Waiser;

U.S. Pat. No. 4,603,676 entitled "Bow drawback mechanism" issued Aug. 5, 1986 to Luoma;

U.S. Pat. No. 4,649,892 entitled "Cross bow with cocking mechanism" issued Mar. 17, 1987 to Bozek;

U.S. Pat. No. 4,697,571 entitled "Cross bows" issued Oct. 6, 1987 to Waiser;

U.S. Pat. No. 4,719,897 entitled "Cocking mechanism for crossbow" issued Jan. 19, 1988 to Gaudreau;

U.S. Pat. No. 4,942,861 entitled "Cross bow with improved cocking mechanism" issued Jul. 24, 1990 to Bozek;

U.S. Pat. No. 5,085,200 entitled "Self-actuating, dry-fire prevention safety device for a crossbow" issued Feb. 4, 1992 to Horton-Corcoran et al;

U.S. Pat. No. 5,115,795 entitled "Crossbow cocking device" issued May 26, 1992 to Farris;

U.S. Pat. No. 5,220,906 entitled "Device to draw the bowstring of a crossbow" issued Jun. 22, 1993 to Choma;

U.S. Pat. No. 5,598,829 entitled "Crossbow dry fire prevention device" issued Feb. 4, 1997 to Bednar;

U.S. Pat. No. 5,649,520 entitled "Crossbow trigger mechanism" issued Jul. 22, 1997 to Bednar;

U.S. Pat. No. 5,823,172 entitled "Crossbow bow string drawing device" issued Oct. 20, 1998 to Suggitt;

U.S. Pat. No. 5,884,614 entitled "Crossbow with improved trigger mechanism" issued Mar. 23, 1999 to Darlington et al;

U.S. Pat. No. 6,095,128 entitled "Crossbow bowstring drawing mechanisms" issued Aug. 1, 2000 to Bednar;

U.S. Pat. No. 6,205,990 entitled "Dry-fire prevention mechanism for crossbows" issued Mar. 27, 2001 to Adkins;

U.S. Pat. No. 6,286,496 entitled "Crossbow bowstring drawing mechanism" issued Sep. 11, 2001 to Bednar;

U.S. Pat. No. 6,736,123 entitled "Crossbow trigger" issued May 18, 2004 to Summers et al;

U.S. Pat. No. 6,799,566 entitled "Automatic cocking device in a crossbow for hunting and archery" issued Oct. 5, 2004 to Malucelli;

U.S. Pat. No. 6,802,304 entitled "Trigger assembly with a safety device for a crossbow" issued Oct. 12, 2004 to Chang;

U.S. Pat. No. 6,913,007 entitled "Crossbow bowstring drawing mechanism" issued Jul. 5, 2005 to Bednar;

U.S. Pat. No. 7,100,590 entitled "Bowstring drawing device for a crossbow" issued Sep. 5, 2006 to Chang;

U.S. Pat. No. 7,770,567 entitled "Safety trigger for a crossbow" issued Aug. 10, 2010 to Yehle;

U.S. Pat. No. 7,784,453 entitled "Draw mechanism for a crossbow" issued Aug. 31, 2010 to Yehle;

U.S. Pat. No. 8,104,461 entitled "Crossbow cocking assembly" issued Jan. 31, 2012 to Kempf;

U.S. Pat. No. 8,240,299 entitled "Release assembly for crossbow" issued Aug. 14, 2012 to Kronengold et al;

U.S. Pat. No. 8,443,790 entitled "Cocking winch apparatus for a crossbow, crossbow system including the cocking winch apparatus, and method of using same" issued May 21, 2013 to Pestrue;

U.S. Pat. No. 8,453,631 entitled "Release assembly for crossbow" issued Jun. 4, 2013 to Kronengold et al;

U.S. Pat. No. 8,499,753 entitled "Integrated cocking device" issued Aug. 6, 2013 to Bednar et al;

U.S. Pat. No. 8,578,917 entitled "Slip clutch" issued Nov. 12, 2013 to Bednar et al;

U.S. Pat. No. 8,899,217 entitled "Bowstring cam arrangement for compound long bow or crossbow" issued Dec. 2, 2014 to Islas;

U.S. Pat. No. 8,950,385 entitled "Crossbow with a crank cocking and release mechanism" issued Feb. 10, 2015 to Khoshnood;

U.S. Pat. No. 9,010,308 entitled "Trigger mechanism for a crossbow" issued Apr. 21, 2015 to Hyde et al;

U.S. Pat. No. 9,140,516 entitled "Trigger mechanism for a crossbow" issued Sep. 22, 2015 to Hyde;

U.S. Pat. No. 9,303,944 entitled "Crossbow with integrated decocking device" issued Apr. 5, 2016 to Barber;

U.S. Pat. No. 9,341,432 entitled "Drawstring cocking assembly" issued May 17, 2016 to Wohleb;

U.S. Pat. No. 9,341,434 entitled "Crossbow cocking crank" issued May 17, 2016 to McPherson et al;

U.S. Pat. No. 9,383,159 entitled "De-cocking mechanism for a bow" issued Jul. 5, 2016 to Pulkrabek et al;

U.S. Pat. No. 9,404,706 entitled "Crossbow with a crank cocking and release mechanism" issued Aug. 2, 2016 to Khoshnood;

U.S. Pat. No. 9,494,380 entitled "String control system for a crossbow" issued Nov. 15, 2016 to Yehle;

U.S. Pat. No. 9,528,792 entitled "Crossbow" issued Dec. 27, 2016 to Chang;

U.S. Pub. No. 2002/0059924 entitled "Crossbow bowstring drawing mechanism" published May 23, 2002 in the name of Bednar;

U.S. Pub. No. 2004/0194771 entitled "Automatic cocking device in a crossbow for hunting and archery" published Oct. 7, 2004 in the name of Malucelli;

U.S. Pub. No. 2005/0022799 entitled "Crossbow rope cocking device" published Feb. 3, 2005 in the name of Bednar;

U.S. Pub. No. 2006/0086346 entitled "Crossbow cocking and stringing device" published Apr. 27, 2006 in the name of Middleton;

U.S. Pub. No. 2006/0144380 entitled "Crossbow" published Jul. 6, 2006 in the name of Kempf;

U.S. Pub. No. 2006/0169258 entitled "Bowstring drawing device for a crossbow" published Aug. 3, 2006 in the name of Chang; and U.S. Pub. No. 2010/0170488 entitled "Compact winding mechanism for crossbow" published Jul. 8, 2010 in the names of Rasor et al.

Each of the references identified above is incorporated by reference as if fully set forth herein.

SUMMARY

An inventive mechanism for drawing, cocking, and triggering a crossbow comprises: a stationary subassembly; a reciprocating subassembly; a winch subassembly; and a stock subassembly of the crossbow including an elongated mainframe with a longitudinal slot. The winch subassembly is mounted in the stock subassembly, the stationary subassembly is mounted on a rearward portion of the mainframe, and the reciprocating subassembly is engaged with the slot of the mainframe so as to be movable along the mainframe between a forward brace position and a rearward drawn position. The winch subassembly comprises a spool, a crank handle coupled to rotate the spool, and a rope coupled to the reciprocating subassembly. Rotation of the spool to take up the rope causes movement of the reciprocating subassembly in a rearward direction along the mainframe in response to tension on the rope. Rotation of the spool to let out the rope permits movement of the reciprocating subassembly in a forward direction along the mainframe.

The reciprocating subassembly comprises a body engaged with the slot of the mainframe, a catch, and a sear. The stationary subassembly comprises a trigger and an actuator. With the reciprocating subassembly in the drawn position and a bowstring of the crossbow retained by the catch, the trigger, the actuator, the sear, and the catch are arranged so that (i) movement of the trigger causes movement of the actuator, (ii) movement of the actuator causes movement of the sear, (iii) movement of the sear permits movement of the catch, and (iv) movement of the catch releases the bowstring.

One or both of the stationary subassembly or the reciprocating subassembly includes a trigger latch movable between a latched position and an unlatched position. The trigger latch is arranged so as to, (i) in the latched position and with the reciprocating subassembly in the drawn position, obstruct movement of the reciprocating subassembly from the drawn position in the forward direction, and (ii) in the unlatched position, permit movement of the reciprocating subassembly from the drawn position in the forward direction.

An inventive crossbow includes the above mechanism and further comprises a pair of bow limbs connected to a forward portion of the mainframe and disposed on opposite sides of the mainframe, and a bowstring connected to ends of the bow limbs. A method for using the inventive crossbow comprises: (A) with the reciprocating subassembly in the brace position, moving the catch to retain the bowstring; (B) using the crank handle, rotating the spool to take up the rope and move the reciprocating subassembly to the drawn position against tension on the bowstring, thus drawing the crossbow; (C) with the trigger latch in the latched position, holding the reciprocating subassembly in the drawn position against the tension on the bowstring; (D) placing a bolt on the slot with a nock of the bolt against the bowstring; and (E) moving the trigger, thereby moving the actuator, moving the sear, permitting the catch to move, releasing the bowstring, and firing the crossbow to launch the bolt. The method can further comprise: (F) moving the trigger latch to the unlatched position; and (G) letting out the rope from the spool and moving the reciprocating subassembly to the brace position.

Objects and advantages pertaining to crossbows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
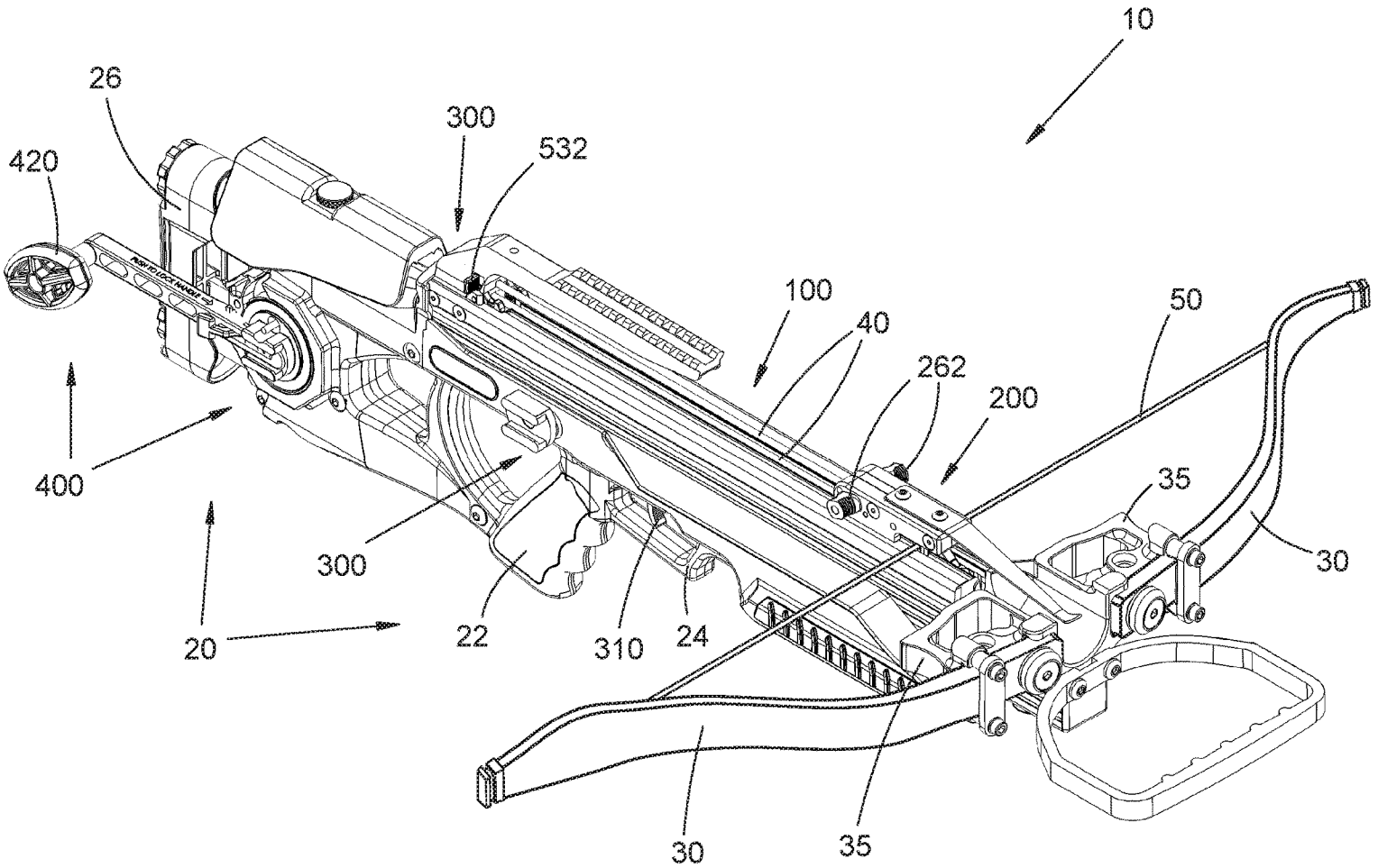
FIGS. 1 and 2 illustrate a crossbow including an inventive mechanism for drawing, cocking, and triggering the crossbow, with the crossbow at brace and at full draw, respectively.

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims. In the drawings, the heavy arrows indicate the movements of the various parts of the trigger assembly mechanism. Single-headed arrows indicate that the designated motion is permitted in both directions but is directly biased in the direction of the single arrowhead. Directly biased means that a suitable bias mechanism (including for example a torsion spring, linear spring, some other resilient member, a weight, an actuator, or some other suitable biasing element or means) is arranged to act directly on that part, and is what is meant when an element, part, or member is described as biased in a particular direction. Biasing elements such as springs are omitted from the Drawings for clarity. Double-headed arrows indicate that the designated motion of the corresponding part is permitted in both directions and is not directly biased in either direction. However, the non-biased part can be indirectly biased by bias or movement of other adjacent parts.

DETAILED DESCRIPTION OF EMBODIMENTS

Figure 2:
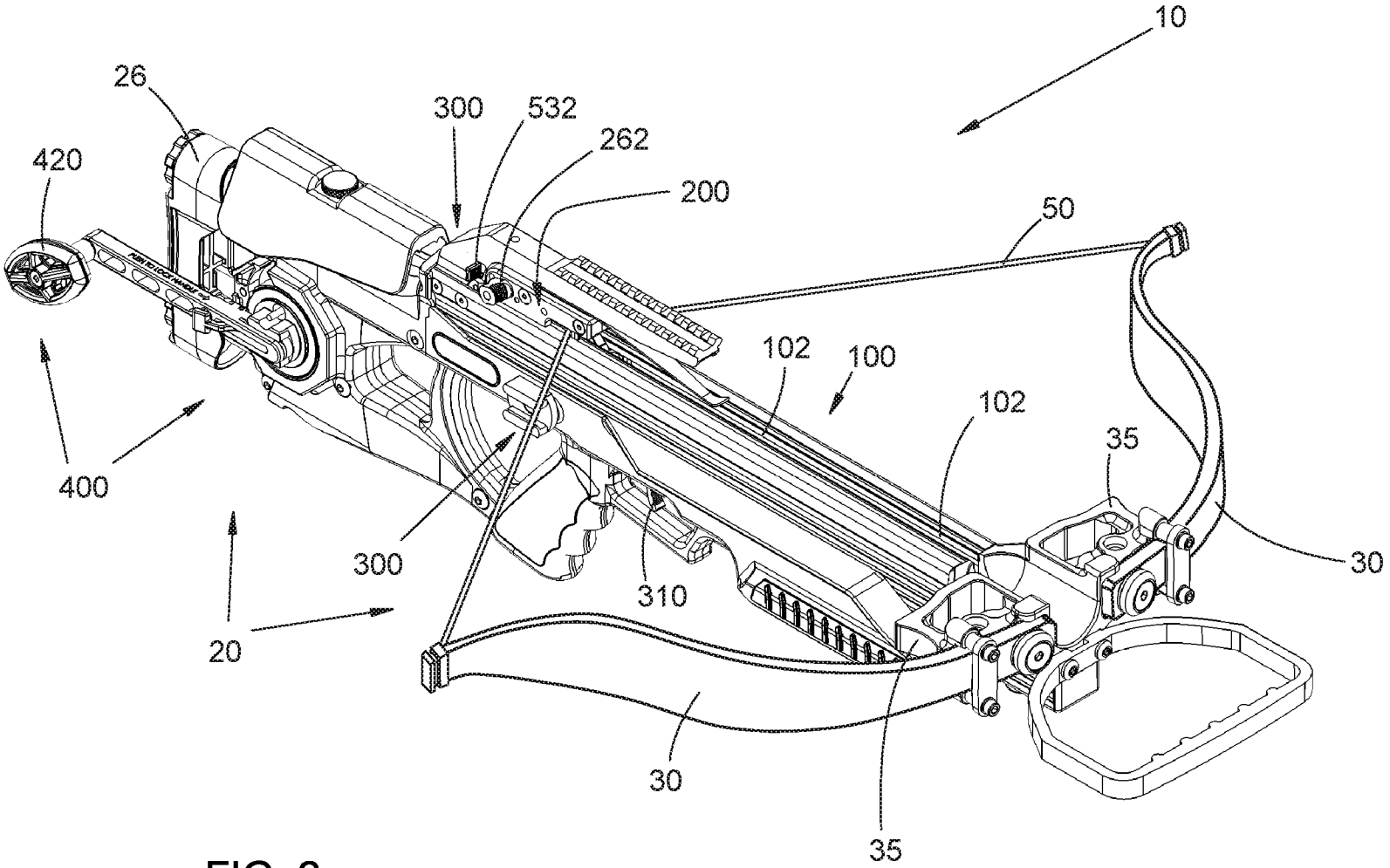

An inventive mechanism for drawing, cocking, and triggering a crossbow comprising a stationary subassembly 300, a reciprocating subassembly 200, a winch subassembly 400, and a stock subassembly 20. A forward portion of the stock subassembly 20 includes an elongated mainframe 100 with a longitudinal slot 102 along its top surface. A crossbow 10 incorporating such an inventive mechanism is shown in FIGS. 1 and 2, at brace and drawn, respectively. The winch subassembly 400 is mounted in the stock subassembly 20 and the stationary subassembly 300 is mounted on a rearward portion of the mainframe 100. The reciprocating subassembly 200 is engaged with the slot 102 of the mainframe 100 so as to be movable along the mainframe 100 between a forward brace position (e.g., as in FIGS. 1, 4, and 5) and a rearward drawn position (e.g., as in FIGS. 2, 3, and 7-11).

Figure 6:
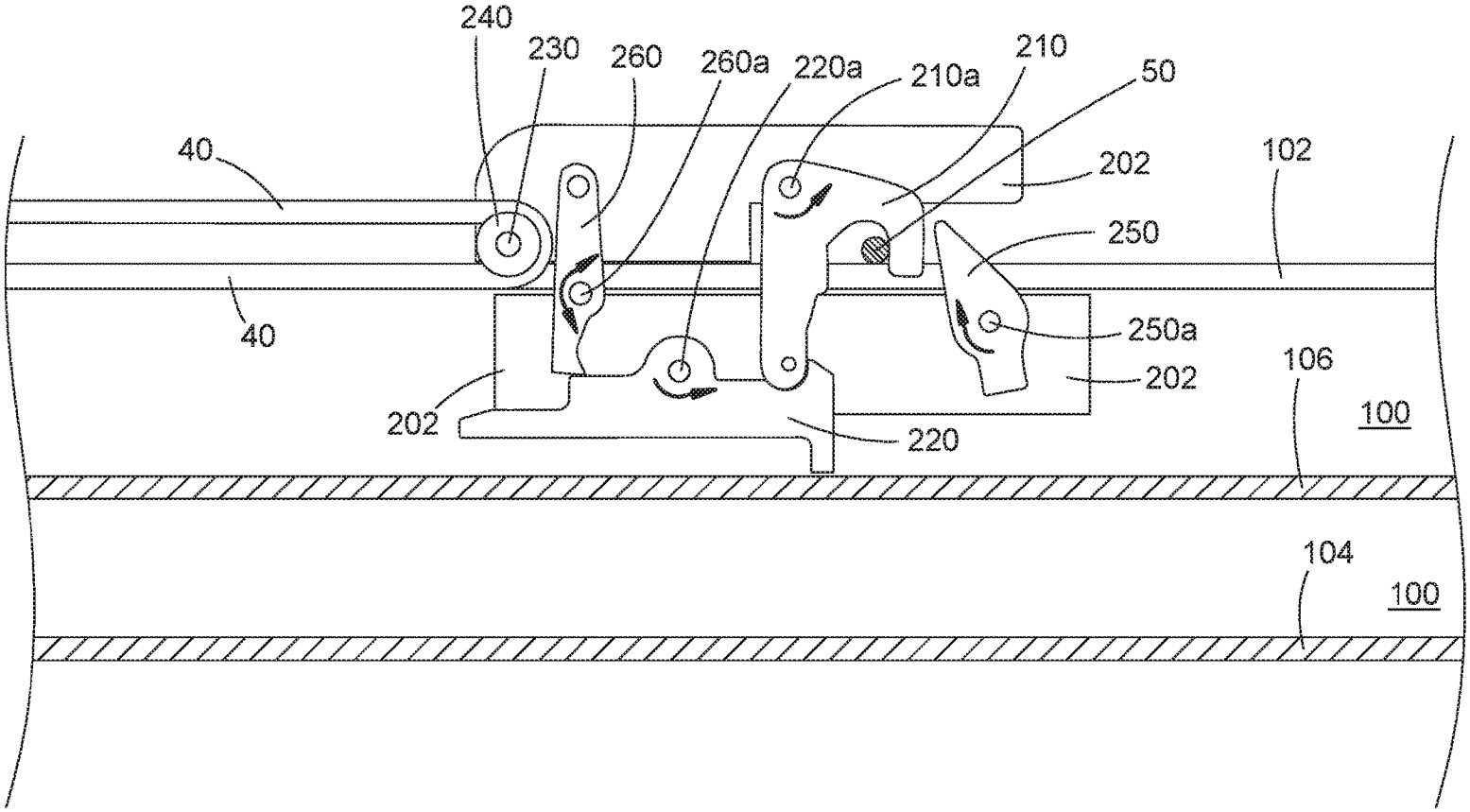
Figure 7:
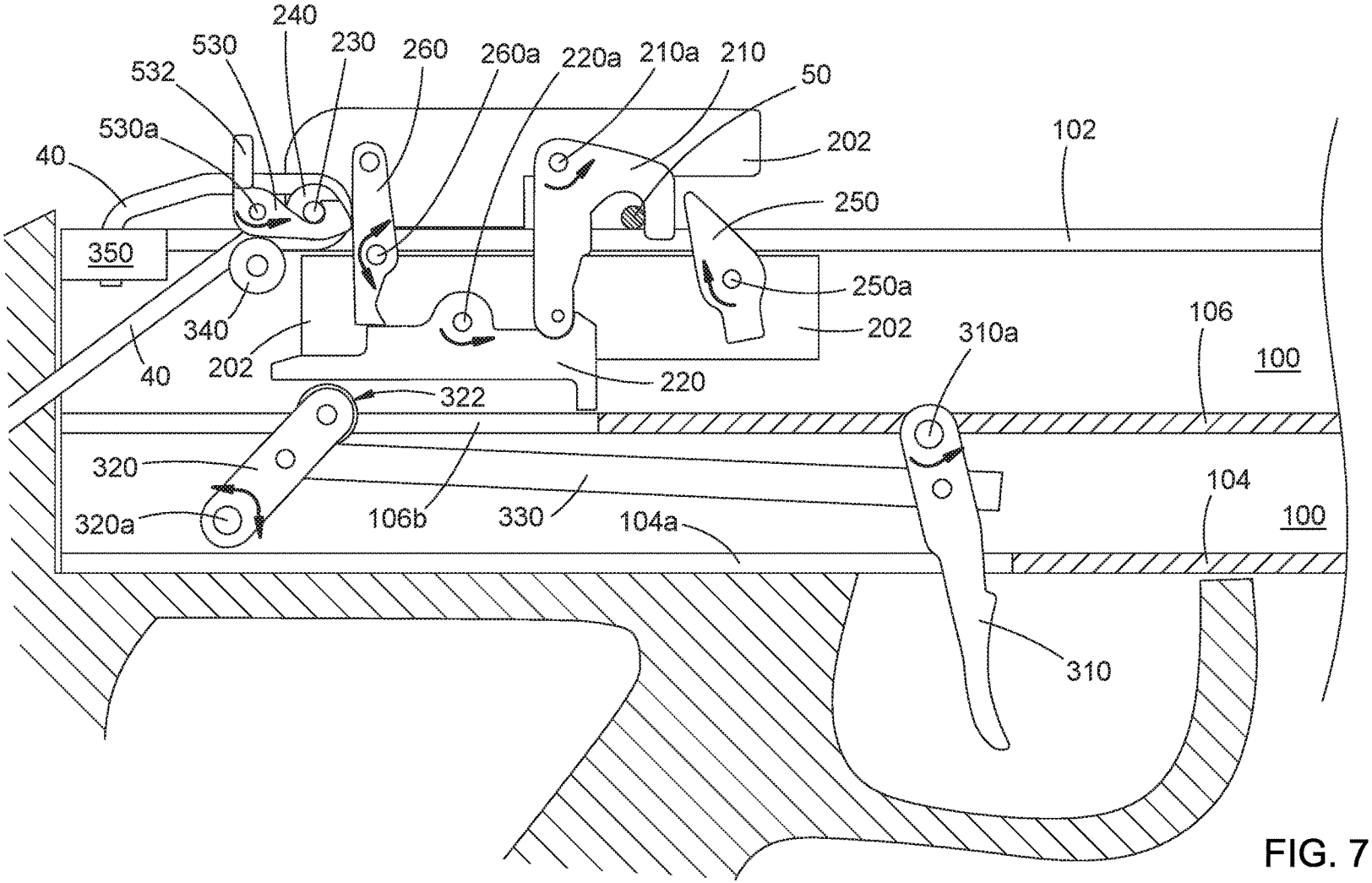
Figure 8:
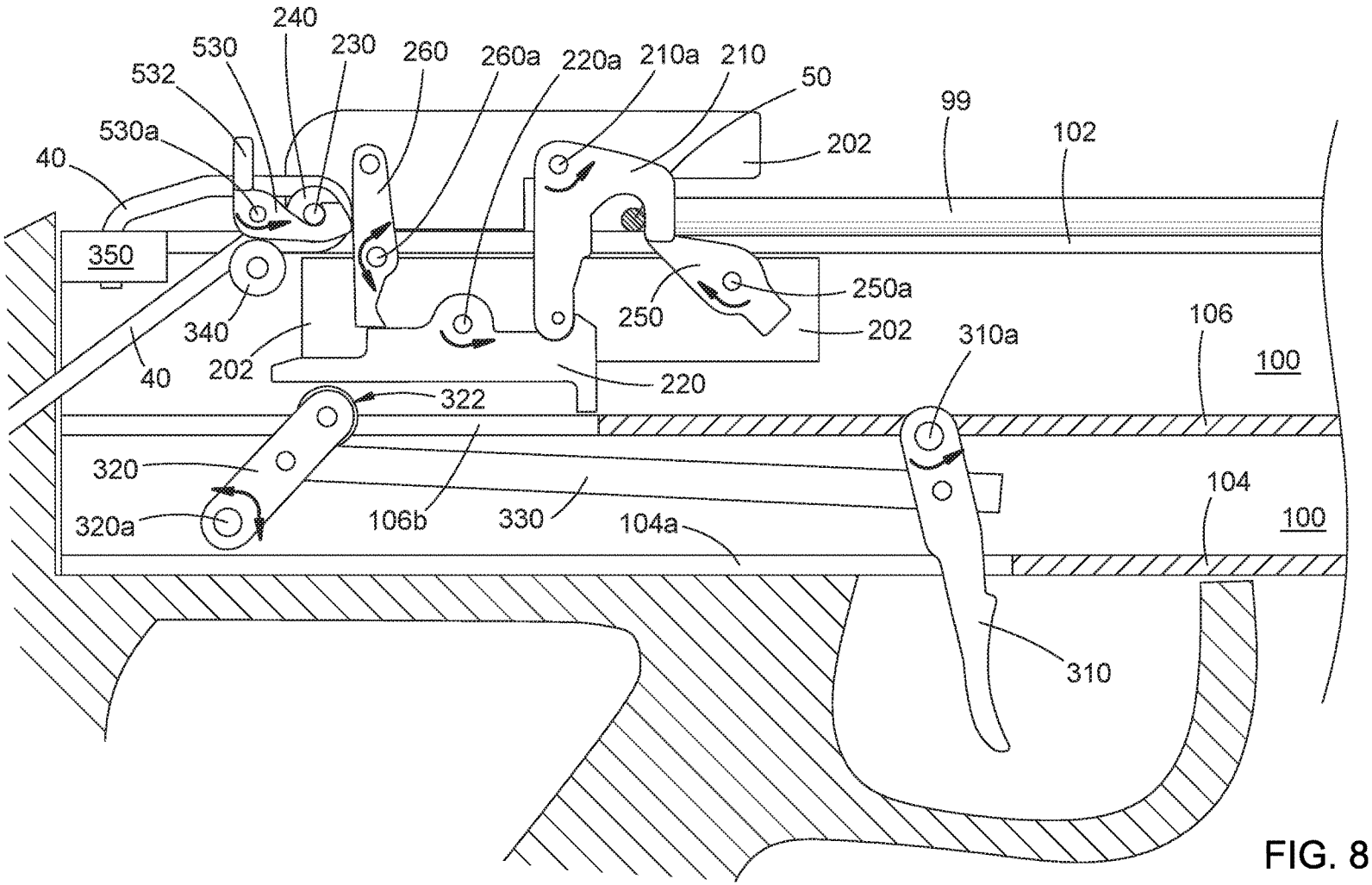
Figure 9:
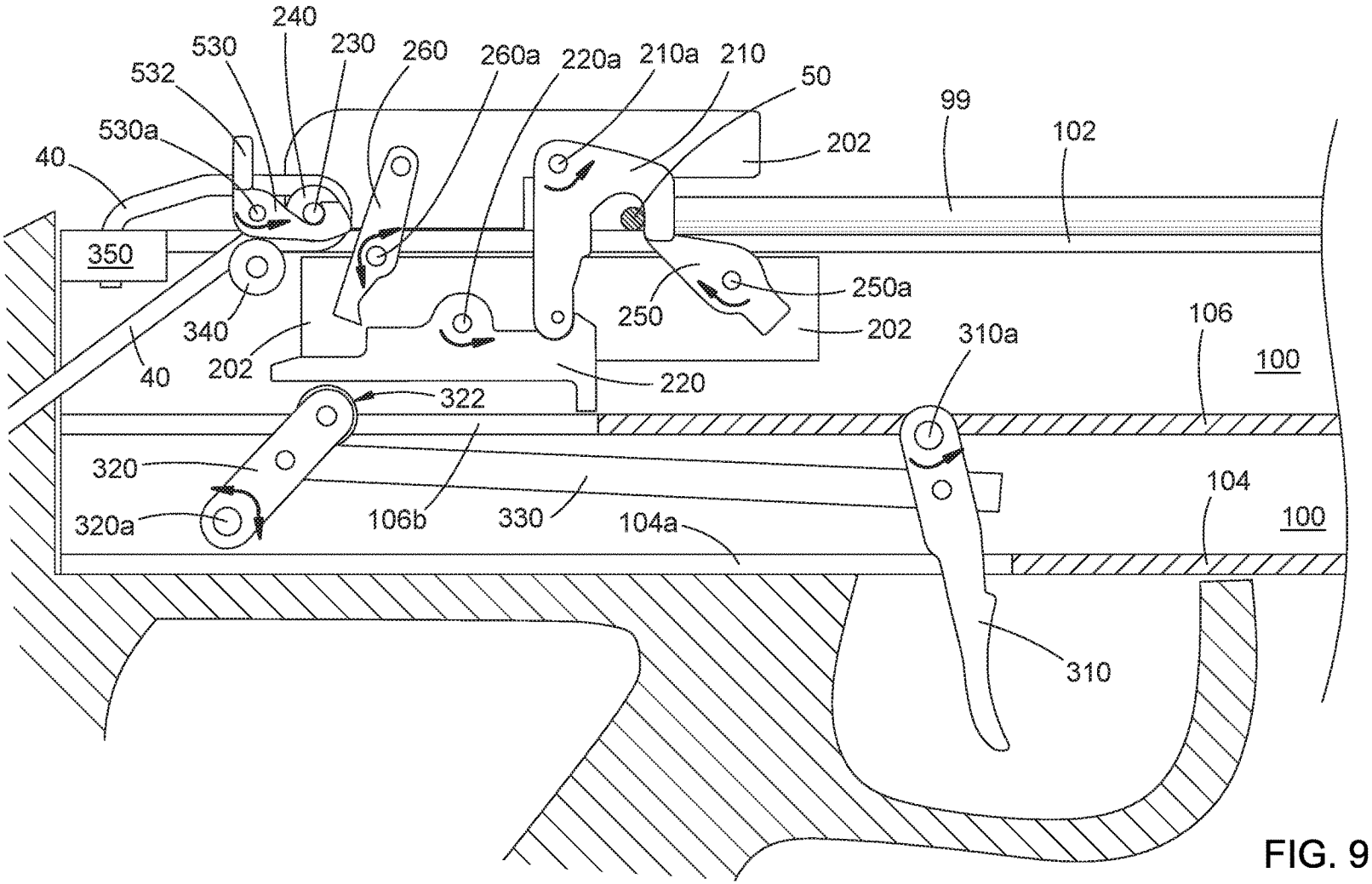
Figure 10:
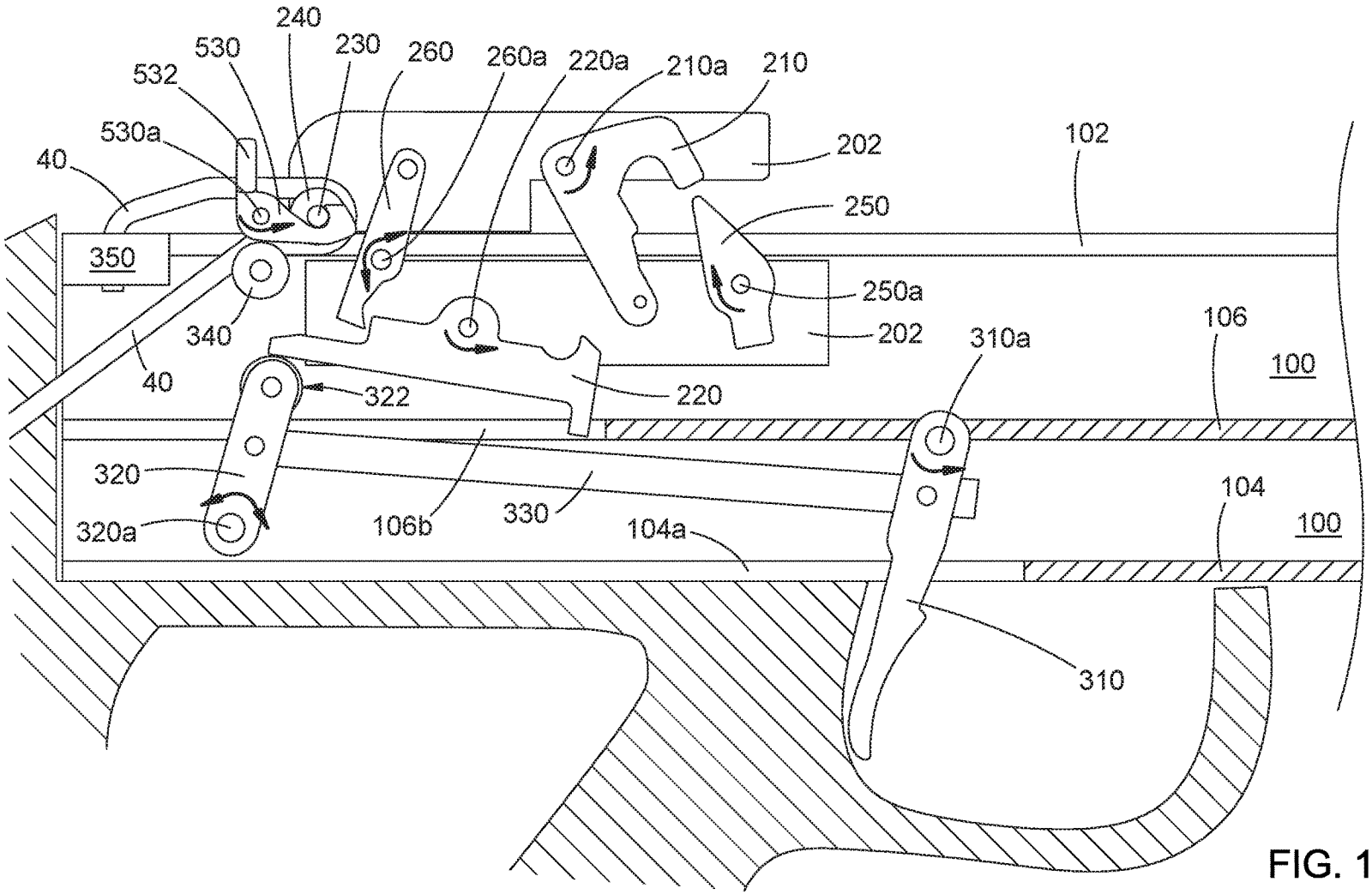
Figure 11:
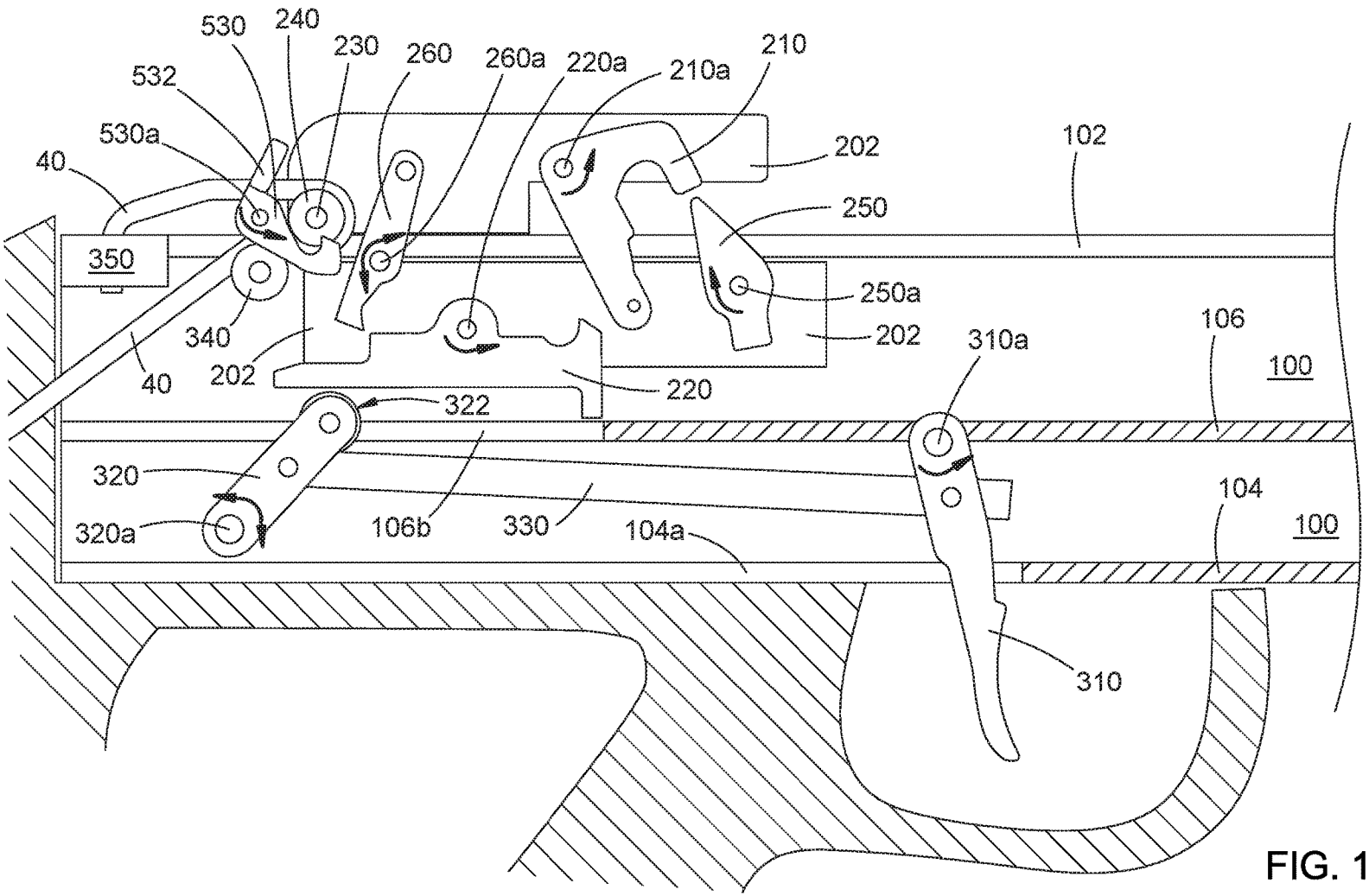

For purposes of the present disclosure and appended claims, when a part, member, subassembly, or other element is described as movable "between" a first position and a second position, the element in question can assume the first position, can move from the first position to the second position, can assume the second position, and can move from the second position to the first position. If it is intended to exclude the first and second positions, the term "intermediate" will be used. For example, FIG. 6 shows the reciprocating subassembly 200 at an intermediate position along the mainframe 100.

Figure 3:
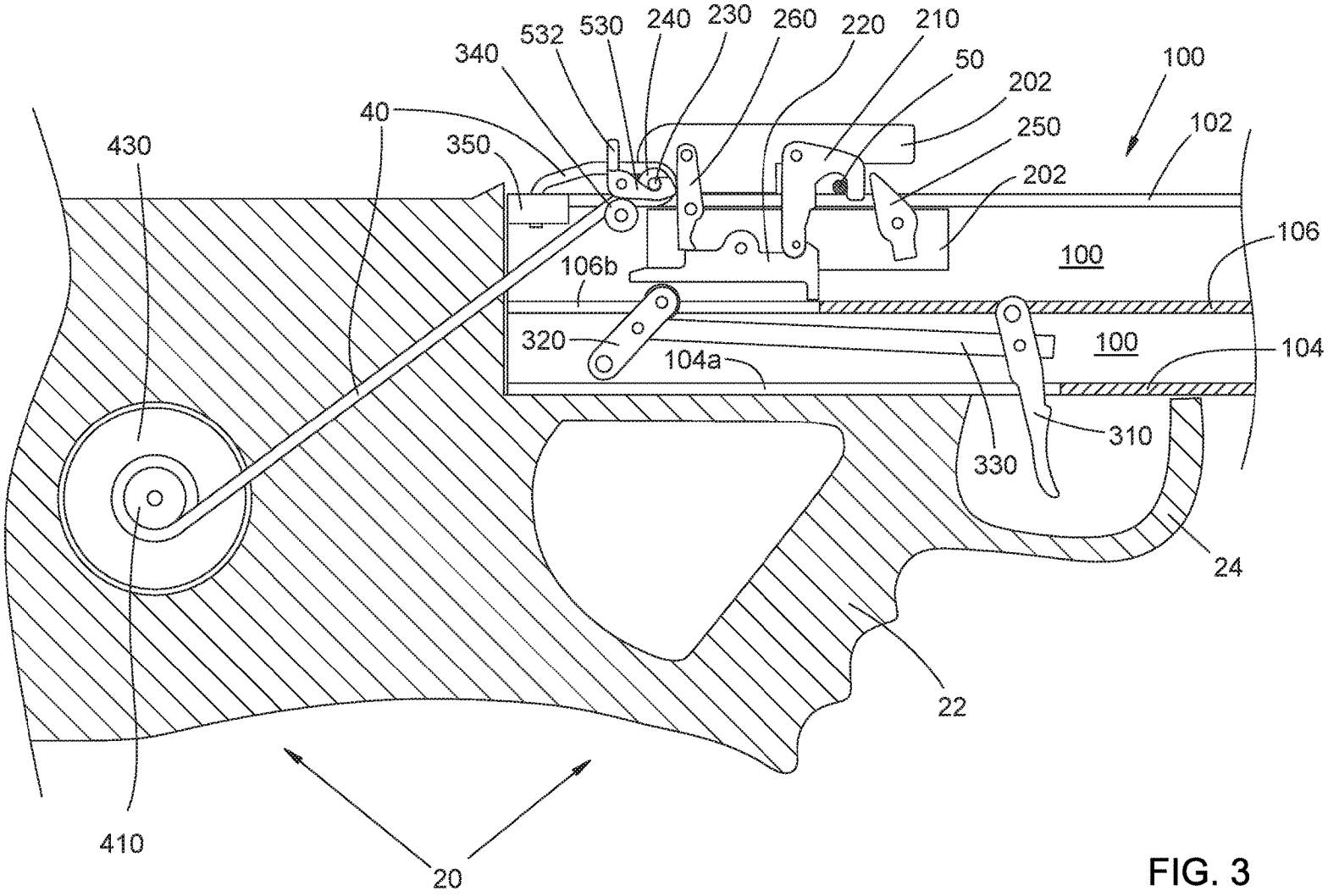
FIG. 3 is a schematic, partially cross sectional, side view of an inventive mechanism for drawing, cocking, and triggering the crossbow.
Figure 4:
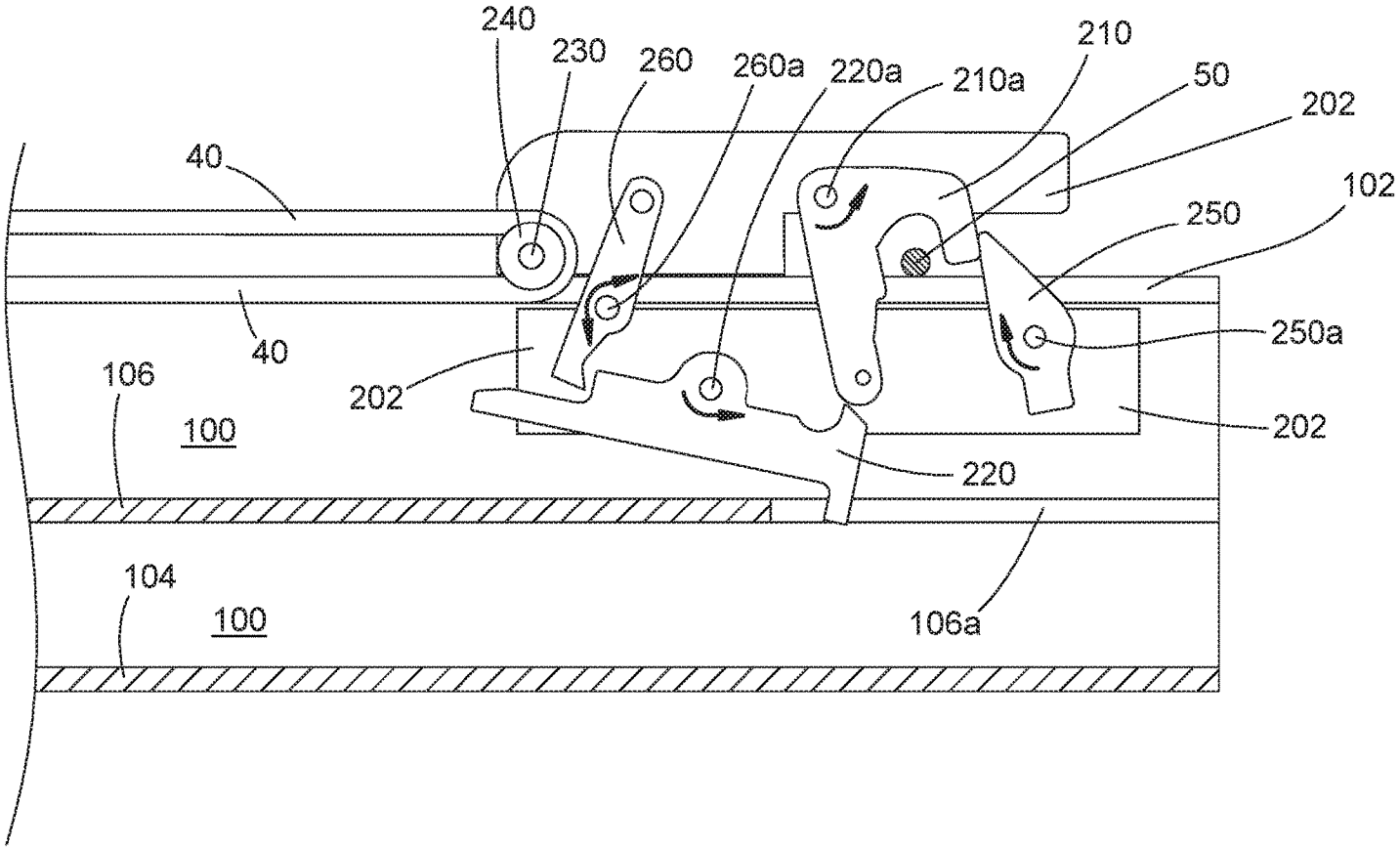
FIGS. 4 through 11 are schematic, partially cross sectional, side views of an inventive mechanism for drawing, cocking, and triggering a crossbow, illustrating a sequence for using the crossbow.
Figure 5:
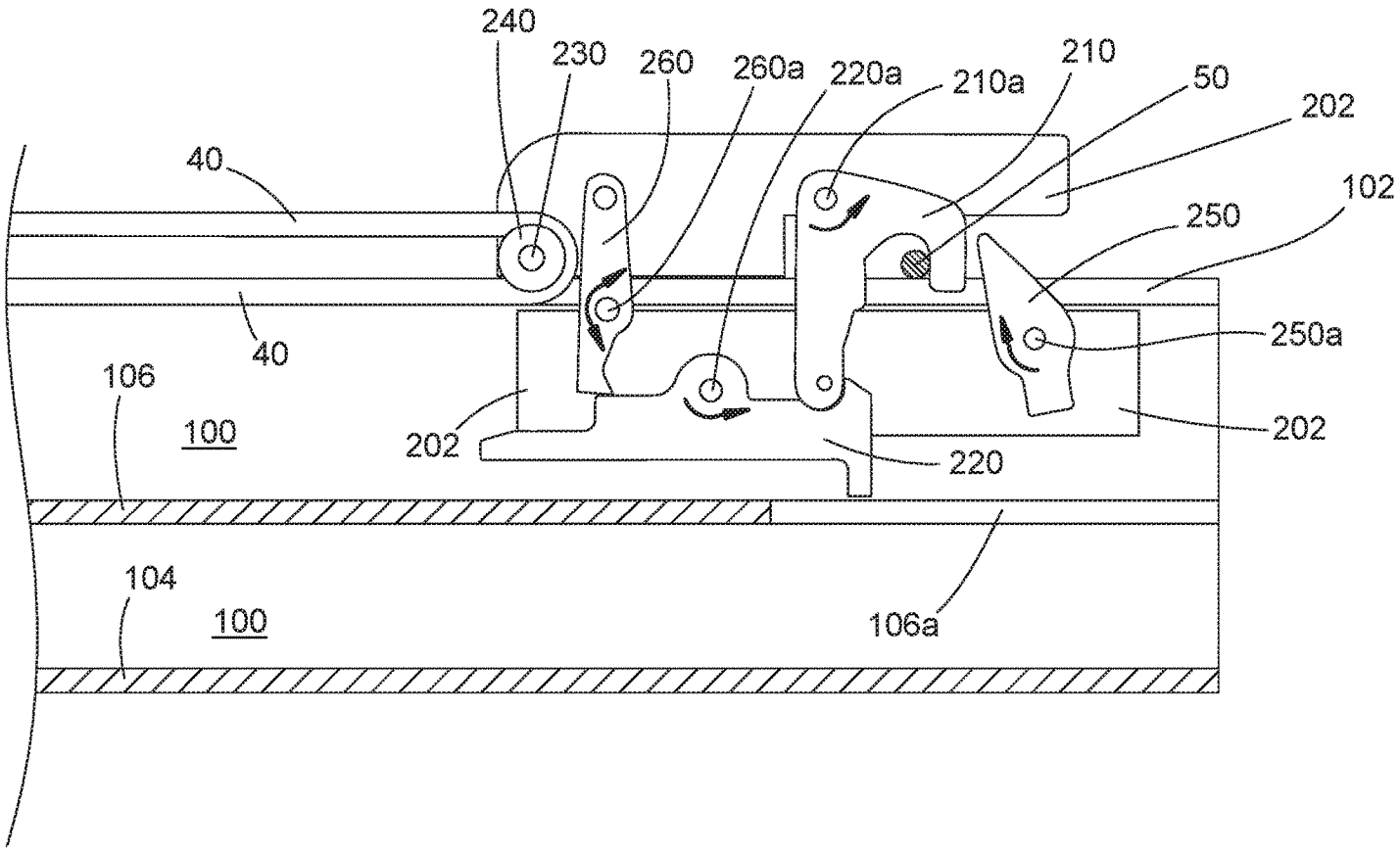

A schematic, partially cross sectional, side view of the mechanism is illustrated schematically in FIG. 3 to give an overview of the inventive mechanism; FIGS. 4-11 are similar, enlarged views illustrating a sequence of arrangements that arise in the course of using the crossbow 10. Although the entirety of the stock subassembly 20 is shown with continuous cross hatching in the drawings, the stock subassembly 20 typically would include multiple parts and various internal spaces or workings. Those have been mostly omitted from the drawings for clarity, but a crossbow mechanism or crossbow including such parts, spaces, or workings shall nevertheless fall within the scope of the present disclosure or appended claims.

The winch subassembly 400 comprises a spool 410, a crank handle 420 coupled to rotate the spool 410, and a rope 40 coupled to the reciprocating subassembly 200. Rotation of the spool 410 to take up the rope 40 causes rearward movement of the reciprocating subassembly 200 along the mainframe 100 in response to tension on the rope 40. Rotation of the spool 410 to let out the rope 40 permits forward movement of the reciprocating subassembly 200 along the mainframe.

The reciprocating subassembly 200 comprises a body 202 engaged with the slot 102 of the mainframe 100, a catch 210, and a sear 220. The stationary subassembly 300 comprises a trigger 310 and an actuator 320. With the reciprocating subassembly 200 in the drawn position and a bowstring 50 of the crossbow 10 retained by the catch 210 (e.g., as in FIG. 9), the trigger 310, the actuator 320, the sear 220, and the catch 210 are arranged so that (i) movement of the trigger 310 causes movement of the actuator 320, (ii) movement of the actuator 320 causes movement of the sear 220, (iii) movement of the sear 220 permits movement of the catch 210, and (iv) movement of the catch 210 releases the bowstring. Those movements result in the arrangement of, e.g., FIG. 10.

It would be desirable to hold the crossbow 10 at full draw without relying on tension on the rope 40. It would be desirable to enable use of the crossbow 10 even if the rope 40 were to break or otherwise become unusable. To that end, the inventive mechanism includes, on one or both of the stationary subassembly 300 or the reciprocating subassembly 200, a trigger latch 530. The trigger latch 530 is movable between a latched position (e.g., as in FIGS. 3 and 7-10) and an unlatched position (e.g., as in FIG. 11). In many examples, the trigger latch 530 is biased (directly, in any suitable way) toward the latched position. In the example shown, the trigger latch rotates about a pivot axis 530*a* between the latched and unlatched positions. In the latched position and with the reciprocating subassembly 200 in the drawn position, the trigger latch 530 obstructs movement of the reciprocating subassembly 200 from the drawn position in the forward direction. In the example shown, the trigger latch 530 is mounted on the stationary subassembly 300 and engages the pulley axle 230 on the reciprocating subassembly 200; that is only one of myriad arrangements that can be employed within the scope of the present disclosure or appended claims, with the trigger latch 530 being mounted on either of the reciprocating or stationary subassemblies 200/300 and engaging a structural element of the other subassembly. Whatever the details of its arrangement, the trigger latch 530 holds the reciprocating subassembly 200 in place at the drawn position without relying on tension on the rope 40. In the unlatched position, the trigger latch 530 permits movement of the reciprocating subassembly 200 from the drawn position in the forward direction, e.g., after firing the crossbow 10 to prepare to draw the bowstring 50 for the next shot. If the rope 40 were broken or otherwise unusable, the crossbow 10 could still be used by using the trigger latch 530 to "park" the reciprocating subassembly at its drawn position and hold it there. In that event, alternate means would be needed for drawing the bowstring 50 in place of using the winch subassembly 400.

The catch 210 is movable between a firing catch position (e.g., as in FIGS. 10 and 11) and a non-firing catch position (e.g., as in FIGS. 3 and 5-9); the catch is biased (directly, in any suitable way) toward the firing catch position. In the example shown, the caliper 210 rotates about a pivot axis 210*a*. The catch can be arranged in any suitable way; a common arrangement is as a so-called caliper, with a pair of laterally spaced-apart prongs that retain the bowstring and straddle a bolt 99 loaded onto the crossbow 10. With the catch 210 in the non-firing catch position, the catch 210 retains the bowstring 50; with the catch 210 in the firing catch position, the catch 210 releases the bowstring 50. The sear 220 is movable between a firing sear position (e.g., as in FIG. 10) and a non-firing sear position (e.g., as in FIGS. 3, 5-9, and 11); the sear 220 is biased (directly, in any suitable way) toward the non-firing sear position. In the example shown, the sear 220 rotates about a pivot axis 220*a*. With the sear 220 in the non-firing sear position, the sear 220 obstructs movement of the catch 210 away from the non-firing catch position; with the sear 220 in the firing sear position, the sear 220 permits movement of the catch 210 to the firing catch position, in response to bias on the catch 210, and thereby cause release of the bowstring 50. In some examples, the catch 210 includes a roller that engages the sear 220 and facilitates movement of the catch 210 past the sear 220 when the crossbow is fired (e.g., in making the transition from FIG. 9 to FIG. 10). Such a roller can also facilitate movement of the catch 210 past the sear 220 when the catch is moved into the non-firing catch position with the reciprocating subassembly is at the brace position (e.g., as in FIG. 4). That motion enables the bowstring to be retained by the catch 210 in preparation for drawing the crossbow 10.

The trigger 310 is movable between a firing trigger position (e.g., as in FIG. 10) and a non-firing trigger position (e.g., as in FIGS. 1-3, 7-9, and 11); the trigger 310 is biased (directly, in any suitable way) toward the non-firing trigger position. In the example shown, the trigger 310 rotates about a pivot axis 310*a*. In a common arrangement, the trigger extends downward through a slot 104*a* through the bottom surface 104 of the mainframe 100. The actuator 320 is coupled to the trigger 310 and movable between a firing actuator position (e.g., as in FIG. 10) and a non-firing actuator position (e.g., as in FIGS. 3, 7-9, and 11). Movement of the trigger 310 to the firing trigger position, against the bias on the trigger 310, causes movement of the actuator 320 to the firing actuator position. With the reciprocating subassembly 200 in the drawn position, movement of the actuator 320 to the firing actuator position causes movement, against bias on the sear 220, of the sear 220 to the firing sear position. In the example shown, the trigger 310 and the actuator 320 are coupled by the linkage 330; that is only one of myriad arrangements that can be employed within the scope of the present disclosure or appended claims. In other examples, discrete trigger 310 and actuator 320 can be coupled directly, without the linkage 330. In still other examples, the trigger 310 and actuator 320 can comprise a single, rigid, unitary structure. In some examples, the actuator 320 includes a roller 322 that engages the sear 220. In some examples, the trigger 310 and the actuator 320 are arranged so that, with the reciprocating subassembly 200 in the drawn position and the trigger 310 held in the non-firing position by the bias on the trigger 310, the actuator 320 does not make contact with the sear 220 (e.g. as in FIGS. 3, 7-9, and 11). With the reciprocating subassembly 200 in the drawn position, movement of the trigger 310 from the non-firing trigger position to the firing trigger position first causes the actuator 320 to make contact with the sear 220 and then causes the actuator 320 to move the sear 220 to the firing sear position (e.g., as in FIG. 10). The lack of contact facilitates movement of the reciprocating subassembly 200 rearward to the drawn position without interference between the actuator 320 and the sear 220.

In many examples, the trigger latch 530 is arranged to be moved manually by a user of the crossbow to the unlatched position, against the bias on the trigger latch 530, to permit forward movement of the reciprocating subassembly 200 from the drawn position in the forward direction (e.g., to prepare for the next shot). In the example shown, the trigger latch 530 includes a lever 532 that protrudes from the stationary subassembly 300 so as to be accessible to the user.

In some examples, the trigger latch 530 is arranged so that rearward movement of the reciprocating subassembly 200 to the drawn position automatically engages the trigger latch 530 with the reciprocating subassembly 200. That rearward movement first causes movement of the trigger latch 530 toward the unlatched position against the bias on the trigger latch. Further rearward movement then permits the trigger latch 530 to move to the latched position in response to the bias on the trigger latch 530, where it then obstructs forward movement of the reciprocating subassembly 200 from the drawn position. In the example shown, a front portion of the trigger latch 530 has a beveled surface. As the reciprocating subassembly 200 move rearward, the pulley axle 240 makes contact with the beveled surface, which then pushes the trigger latch 530 toward the unlatched position. Upon sufficient rearward movement, the trigger latch 530 is able to snap back to the latched position, in response to the bias, and engage the axle 240 to hold the reciprocating subassembly 200 in the drawn position.

In many examples, the crank handle 420 is detachable from the spool 410. That arrangement can be desirable to avoid interference with aiming and firing the bow after the hand crank 420 was used to draw the crossbow 10. The detached hand crank 420 can be stowed, e.g., in a clothing pocket or in a crossbow case. In some examples the crossbow 10 can include a storage bracket for attaching the hand crank 420 to the crossbow 10 in an out-of-the-way location on the crossbow 10. Note that the winch assembly 400 generally, and the spool 410 in particular, typically are not directly biased (e.g., by a spring or other biasing element) to rotate in one direction versus the other. However, tension on the bowstring 50 during drawing of the crossbow 10 and while holding the bowstring 50 at full draw will tend to pull the reciprocating subassembly 200 forward, and the resulting tension on the rope 40 will tend to rotate the spool 410 to let out the rope 40. The winch subassembly 400 can therefore include a clutch 430, of any suitable type, to prevent unwanted let-out of the rope 40 from the spool 410 in response to tension on the rope 40 (arising from tension on the bowstring 50 retained by the catch 210). The clutch 430 allows free rotation of the spool 410 to take up the rope 40 and the hand crank 420 is turned to draw the crossbow 10. Suitable examples of the clutch 430 include a sprag clutch, a ratchet-and-pawl-type clutch, or other suitable freewheel clutch.

To prepare for the next shot after firing the crossbow 10, or if it desired to decock the crossbow 10 without firing, the reciprocating subassembly 200 must be moved forward to the brace position. In some examples, that forward motion requires operation of the hand crank 420 to let out the rope 40 from the spool 410 in a controlled manner, despite tension on the bowstring 50 and the rope 40. In examples that include a clutch, the clutch 430 can be arranged to allow disengagement of the clutch 430 and free rotation of the spool 410 to let out the rope 40; typically the hand crank 410 would be employed in conjunction with disengagement of the clutch 430, to control movement of the reciprocating subassembly 200 under tension from the bowstring 50. Any suitable arrangement can be employed to enable engagement and disengagement of the clutch 430. In some examples, the clutch 430 is biased toward engagement, and therefore requires the user to apply a force or torque to manually disengage the clutch 430 when needed or desired.

In some examples the rope 40 is simply attached directly to the reciprocating subassembly 200. Any suitable attachment can be employed, such as a clamp, loop, or anchor. In the case of a simple, direct attachment, force exerted by the rope 40 on the reciprocating subassembly 200, as the crossbow is drawn, is about equal to the tension on the rope 40 (neglecting effects of friction or misalignment). In other examples, including the example shown in the drawings, the reciprocating subassembly 200 includes a pulley 240 which rotates about the pulley axle 230. The rope 40 is looped around the pulley 240 and connected directly to the stationary subassembly 300 or the stock subassembly 20 (e.g., rope anchor 350 in the example shown in the drawings). In such a so-called block-and-tackle arrangement, force exerted on the reciprocating subassembly 200, as the bow is drawn, is about equal to two times the tension on the rope 40 (again, neglecting effects of friction or misalignment). The pulley 340 redirects the rope 40 between the spool 410 and the reciprocating subassembly 200 so that the force applied is substantially parallel to the direction of movement of the reciprocating subassembly 200. In the example shown, the pulley axle 230 doubles as the engagement point on the reciprocating subassembly for the trigger latch 530. That is a convenient arrangement, but need not be the case. In other examples, structural elements for engaging the trigger latch 530 can be distinct from the pulley 240 and its axle 230.

Unintentional firing of the crossbow 10, and so-called dry-firing of the crossbow 10 (whether intentional or unintentional) are significant safety concerns. To reduce the likelihood of unintentional firing of the crossbow 10, the reciprocating subassembly can include a safety member 260 that is movable by a user of the crossbow 10 between a safety-on position (e.g., as in FIGS. 1, 3, and 5-8, and a safety-off position (e.g., as in FIGS. 4 and 9-11). In some examples, the safety member 260 is not biased to move in either direction; in some examples, the safety member can be biased so as to move automatically to the safety-on position in the absence of action by the user. In some examples the reciprocating subassembly 200 can be arranged so that the safety member 260 can be retained in the safety-on position, in the safety-off position, or both, by a suitably arranged detent mechanism (e.g., so as to enable movement of the safety member 260 in response to action of the user, but to inhibit accidental or unintentional movement of the safety member 260). In the example shown, the safety member 260 rotates about a pivot axis 260*a* and is not biased to rotate in either direction. With the safety member 260 in the safety-on position, the safety member 260 obstructs movement of the sear 220 from the non-firing sear position; with the safety member 260 in the safety-off position, the safety member 260 does not obstruct movement of the sear 220 to the firing sear position. In the example shown, a pair of safety knobs 262 are attached to the safety member 260 and protrude to enable the user to move the safety member 260 to the desired position.

It may be desirable to wholly preclude firing of the crossbow 10 under certain conditions. For example, it may be desirable to prevent firing, even with the safety member 260 in the safety-off position, when the reciprocating subassembly 200 is at an intermediate position along the mainframe 100 (e.g., during drawing or decocking the crossbow 10). In some examples, the sear 220 and the mainframe 100 are arranged so that, with the reciprocating subassembly 100 at intermediate positions along the mainframe 100, the mainframe 100 obstructs movement of the sear 220 to the firing sear position. With the reciprocating subassembly 200 in the brace position or the drawn position, the mainframe 100 does not obstruct movement of the sear 220 to the firing sear position, thereby permitting movement of the catch 210 between the non-firing catch position and the firing catch position. In the example shown, the mainframe 100 includes a horizontal interior partition 106. With the reciprocating subassembly 200 at an intermediate position along the mainframe 100, the interior partition 106 obstructs movement of the sear 220 to the firing sear position (e.g., as in FIG. 6). The sear 220 cannot move even if the safety member 260 is in the safety-off position. The interior partition 106 has a forward slot 106*a* and a rearward slot 106*b*. The forward slot 106*a* permits movement of the sear 220 to the firing sear position with the reciprocating subassembly 200 at the brace position (if the safety member 260 is in the safety-off position; e.g., as in FIG. 4). That movement at that position enables the catch 210 to be moved, against its bias, to the non-firing catch position to capture the bowstring 50 for drawing the crossbow 10. If the sear 220 could not move toward the firing sear position, the catch could not be moved to the non-firing catch position. The rearward slot 106*b* permits movement of the sear 220 to the firing sear position (if the safety member 260 is in the safety-off position; e.g., as in FIG. 10). That movement at that position enables the crossbow 10 to be fired.

Dry-firing the crossbow (i.e., firing a drawn crossbow without a bolt loaded) is another safety hazard. To reduce the likelihood of a dry-fire, in some examples the reciprocating subassembly 200 includes a bowstring latch 250. The bowstring latch is movable between a bolt-present position (e.g., as in FIGS. 8 and 9) and a bolt-absent position (e.g., as in FIGS. 3-7, 10, and 11). In the example shown, the bowstring latch 250 rotates about a pivot axis 250*a*. The bowstring latch 250 is biased (directly, in any suitable way) toward the bolt-absent position. With the bowstring latch 250 in the bolt-absent position, the bowstring latch 250 obstructs forward movement of the bowstring 50 from a position rearward of the bowstring latch 250 to a position forward of the bowstring latch 250; with the bowstring latch 250 in the bolt-present position, the bowstring latch 250 does not obstruct forward movement of the bowstring 50 from a position rearward of the bowstring latch to a position forward of the bowstring latch. With the catch 210 in the non-firing catch position retaining the bowstring 50, the reciprocating subassembly 200 in the drawn position, and a bolt 99 loaded onto the mainframe 100 with a nock against the bowstring 50, the bolt 99 holds the bowstring latch 250 in the bolt-present position against the bias on the bowstring latch 250. With no bolt 99 loaded onto the mainframe 100, the bowstring latch 250 is held in the bolt-absent position by the bias on the bowstring latch 250.

An inventive crossbow 10 includes the stationary subassembly 300, the reciprocating subassembly 200, the winch subassembly 400, and the stock subassembly 20, and further includes a pair of bow limbs 30 connected to a forward portion of the mainframe 100 and disposed on opposite sides of the mainframe 100, and the bowstring 50 connected to ends of the bow limbs 30. In some examples each limb 30 of the pair is a single so-called solid limb (as shown); in other examples, each limb 30 of the pair is a so-called split limb comprising a pair of spaced-apart limb members (not shown). In some examples the bow limbs 30 are connected directly to the forward portion of the mainframe 100. In other examples, including the example shown, the crossbow 10 includes a riser 35 connected directly to the forward portion of the mainframe 100, with the bow limbs 30 connected to the riser 35. In some examples, including the example shown, the bow limbs 30 are arranged so that the crossbow 10 is arranged as a recurve crossbow. In some examples, the crossbow includes a pair of pulley members and one or more cables coupled to one or both pulley members or to the mainframe 100 or to a riser 35. Each pulley member is rotatably mounted on a corresponding one of the bow limbs 30, and the bowstring 50 and the one or more cables are each engaged with one or both pulley members so that the crossbow 10 is arranged as a compound crossbow.

A method for using the crossbow 10 comprises: (A) with the reciprocating subassembly 200 in the brace position, moving the catch 210 to the non-firing catch position to retain the bowstring 50 (e.g., as in FIGS. 4 and 5); (B) using the crank handle 420, rotating the spool 410 to take up the rope 40 and move the reciprocating subassembly 200 to the drawn position against tension on the bowstring 40, thus drawing the crossbow 10 (e.g. as in FIGS. 6 and 7); (C) with the trigger latch 530 in the latched position, holding the reciprocating subassembly 200 in the drawn position against the tension on the bowstring 50 (e.g., as in FIGS. 7-9); (D) placing a bolt 99 on the slot 102 with a nock of the bolt 99 against the bowstring 50 (e.g., as in FIGS. 8 and 9); and (E) moving the trigger 310 to the firing trigger position, thereby moving the actuator 320 to the firing actuator position, moving the sear 220 to the firing sear position, permitting the catch 210 to move to the firing catch position, releasing the bowstring 50, and firing the crossbow 10 to launch the bolt 99 (e.g., as in FIG. 10).

The method for using the crossbow 10 can further comprise, after firing the crossbow 10: (F) moving the trigger latch 530 to the unlatched position (e.g., as in FIG. 11); and (G) letting out the rope 40 from the spool 410 and moving the reciprocating subassembly 200 to the brace position (e.g., in preparation for repeating FIGS. 4 and 5). If the crossbow 10 includes a safety, the method can further include: after part (A) and before part (B), moving the safety member to the safety-on position (e.g. as in FIG. 5); and after part (D) and before part (E), moving the safety member to the safety-off position (e.g., as in FIG. 9). If the crossbow 10 includes a clutch 430 that can be disengaged, the method can further include, after part F) and before part (G), disengaging the clutch 430. If it is desired to decock the bow, the method can include, instead of parts (D) and (E): (D')

moving the trigger latch 530 to the unlatch position; and (E') using the crank handle 420, rotating the spool 410 to let out the rope 40 and permit the reciprocating subassembly 200 to move to the brace position. If the crossbow 10 has a clutch 430, that latter method can further include, after part (D') and before part (E'), disengaging the clutch 430.

In addition to the preceding, the following examples fall within the scope of the present disclosure or appended claims:

Example 1

A mechanism for drawing, cocking, and triggering a crossbow, the mechanism comprising: a stationary subassembly; a reciprocating subassembly; a winch subassembly; and a stock subassembly of the crossbow including an elongated mainframe with a longitudinal slot, wherein: (a) the winch subassembly is mounted in the stock subassembly, the stationary subassembly is mounted on a rearward portion of the mainframe, and the reciprocating subassembly is engaged with the slot of the mainframe so as to be movable along the mainframe between a forward brace position and a rearward drawn position; (b) the reciprocating subassembly comprises a body engaged with the slot of the mainframe, a catch, and a sear; (c) the stationary subassembly comprises a trigger and an actuator; (d) the winch subassembly comprises a spool, a crank handle coupled to rotate the spool, and a rope coupled to the reciprocating subassembly so that (i) rotation of the spool to take up the rope causes movement of the reciprocating subassembly in a rearward direction along the mainframe in response to tension on the rope, and (ii) rotation of the spool to let out the rope permits movement of the reciprocating subassembly in a forward direction along the mainframe; and (e) with the reciprocating subassembly in the drawn position and a bowstring of the crossbow retained by the catch, the trigger, the actuator, the sear, and the catch are arranged so that (i) movement of the trigger causes movement of the actuator, (ii) movement of the actuator causes movement of the sear, (iii) movement of the sear permits movement of the catch, and (iv) movement of the catch releases the bowstring; (f) one or both of the stationary subassembly or the reciprocating subassembly includes a trigger latch movable between a latched position and an unlatched position and arranged so as to, (i) in the latched position and with the reciprocating subassembly in the drawn position, obstruct movement of the reciprocating subassembly from the drawn position in the forward direction, and (ii) in the unlatched position, permit movement of the reciprocating subassembly from the drawn position in the forward direction.

Example 2

The mechanism of Example 1 wherein: (b') the catch is movable between a firing catch position and a non-firing catch position and biased toward the firing catch position, the sear is movable between a firing sear position and a non-firing sear position and biased toward the non-firing sear position, and the catch and sear are arranged so that (i) with the catch in the non-firing catch position, the catch is arranged to retain the bowstring, (ii) with the catch in the firing catch position, the catch is arranged to release the bowstring, (iii) with the sear in the non-firing sear position, the sear is arranged to obstruct movement of the catch away from the non-firing catch position, and (iv) with the sear in the firing sear position, the sear is arranged to permit movement of the catch to the firing catch position in response to bias on the catch and thereby cause release of the bowstring; (c') the trigger is movable between a firing trigger position and a non-firing trigger position and biased toward the non-firing trigger position, the actuator is coupled to the trigger and movable between a firing actuator position and a non-firing actuator position, and the trigger and actuator are arranged so that (i) movement, against bias on the trigger, of the trigger to the firing trigger position causes movement of the actuator to the firing actuator position, and (ii) with the reciprocating subassembly in the drawn position, movement of the actuator to the firing actuator position causes movement, against bias on the sear, of the sear to the firing sear position; and (f') the trigger latch is biased toward the latched position.

Example 3

The mechanism of any one of Examples 1 or 2 wherein the trigger latch is arranged so as to be moved manually by a user of the crossbow to the unlatched position against bias on the trigger latch, thereby permitting movement of the reciprocating subassembly from the drawn position in the forward direction.

Example 4

The mechanism of any one of Examples 1 through 3 wherein the trigger latch is arranged so that movement of the reciprocating subassembly to the drawn position (i) first causes movement of the trigger latch toward the unlatched position against bias on the latch, and (ii) then permits the trigger latch to move to the latched position in response to bias on the latch, thereby obstructing movement of the reciprocating subassembly from the drawn position in the forward direction.

Example 5

The mechanism of any one of Examples 1 through 4 wherein, with the catch in the non-firing catch position retaining the bowstring, the reciprocating subassembly in the drawn position, and the trigger latch in the latched position, the trigger latch is arranged so as to hold the reciprocating subassembly in the drawn position against tension on the bowstring, independent of tension on the rope.

Example 6

The mechanism of any one of Examples 1 through 5 wherein the crank handle is detachable from the spool.

Example 7

The mechanism of any one of Examples 1 through 6 wherein winch subassembly further comprises a clutch arranged so that (i) with the clutch engaged, the spool can rotate only to take up the rope, and (ii) with the clutch disengaged, the spool can rotate to take up or let out the rope.

Example 8

The mechanism of Example 7 wherein the clutch is biased toward engagement, and can be disengaged by movement against bias on the clutch.

Example 9

The mechanism of any one of Examples 7 or 8 wherein the clutch includes a sprag clutch.

Example 10

The mechanism of any one of Examples 7 or 8 wherein the clutch includes a ratchet and pawl.

Example 11

The mechanism of any one of Examples 1 through 10 wherein the rope is connected directly to the reciprocating subassembly so that, with the bowstring retained by the catch, operation of the winch to move the reciprocating subassembly in the rearward direction and draw the crossbow results in force applied to the reciprocating subassembly that is about equal to tension on the rope.

Example 12

The mechanism of any one of Examples 1 through 10 wherein the reciprocating subassembly includes a pulley, and the rope is looped around the pulley and connected directly to the stationary subassembly or the stock subassembly so that, with the bowstring retained by the catch, operation of the winch to move the reciprocating subassembly in the rearward direction and draw the crossbow results in force applied to the reciprocating subassembly that is about two times larger than tension on the rope.

Example 13

The mechanism of any one of Examples 1 through 12 wherein the reciprocating subassembly further comprises a safety member movable between a safety-on position and a safety-off position and arranged so that (i) with the safety member in the safety-on position, the safety member obstructs movement of the sear from the non-firing sear position, and (ii) with the safety member in the safety-off position, the safety member does not obstruct movement of the sear to the firing sear position.

Example 14

The mechanism of any one of Examples 1 through 13 wherein the reciprocating subassembly further comprises a bowstring latch movable between a bolt-present position and a bolt-absent position and biased toward the bolt-absent position, and the bowstring latch is arranged so that (i) with the bowstring latch in the bolt-absent position, the bowstring latch obstructs forward movement of the bowstring from a position rearward of the bowstring latch to a position forward of the bowstring latch, (ii) with the bowstring latch in the bolt-present position, the bowstring latch does not obstruct forward movement of the bowstring from a position rearward of the bowstring latch to a position forward of the bowstring latch, (iii) with the catch in the non-firing catch position retaining the bowstring, the reciprocating subassembly in the drawn position, and a bolt loaded onto the mainframe with a nock against the bowstring, the bolt holds the bowstring latch in the bolt-present position against bias on the bowstring latch, and (iv) with no bolt loaded onto the mainframe, the bowstring latch is held in the bolt-absent position by the bias on the bowstring latch.

Example 15

The mechanism of any one of Examples 1 through 14 wherein the sear and the mainframe are arranged so that (i) with the reciprocating subassembly at intermediate positions along the mainframe, the mainframe blocks movement of the sear to the firing sear position, and (ii) with the reciprocating subassembly in the brace position or the drawn position, the mainframe does not obstruct movement of the sear to the firing sear position.

Example 16

The mechanism of any one of Examples 1 through 15 wherein the catch includes a roller that engages the sear.

Example 17

The mechanism of any one of Examples 1 through 16 wherein the actuator includes a roller that engages the sear.

Example 18

The mechanism of any one of Examples 1 through 17 wherein the trigger and the actuator are arranged so that (i) with the reciprocating subassembly in the drawn position and the trigger held by the bias on the trigger in the non-firing trigger position, the actuator does not make contact with the sear, and (ii) with the reciprocating subassembly in the drawn position, movement of the trigger from the non-firing trigger position to the firing trigger position first causes the actuator to make contact with the sear and then causes the actuator to move the sear to the firing sear position.

Example 19

A crossbow incorporating the mechanism of any one of Examples 1 through 18, the crossbow further comprising: a pair of bow limbs connected to a forward portion of the mainframe and disposed on opposite sides of the mainframe; and a bowstring connected to ends of the bow limbs.

Example 20

The crossbow of Example 19 wherein the bow limbs are connected directly to the forward portion of the mainframe.

Example 21

The crossbow of Example 19 further comprising a riser connected directly to the forward portion of the mainframe, wherein the bow limbs are connected to the riser.

Example 22

The crossbow of any one of Examples 19 through 21 wherein the bow limbs are arranged so that the crossbow is arranged as a recurve crossbow.

Example 23

The crossbow of any one of Examples 19 through 21 further comprising a pair of pulley members and one or more cables coupled to one or both pulley members or to the mainframe or to a riser, wherein each pulley member is rotatably mounted on a corresponding one of the bow limbs, and the bowstring and the one or more cables are each engaged with one or both pulley members so that the crossbow is arranged as a compound crossbow.

Example 24

A method for using the crossbow of any one of Examples 19 through 23, the method comprising: (A) with the reciprocating subassembly in the brace position, moving the catch to the non-firing catch position to retain the bowstring; (B) using the crank handle, rotating the spool to take up the rope and move the reciprocating subassembly to the drawn position against tension on the bowstring, thus drawing the crossbow; (C) with the trigger latch in the latched position, holding the reciprocating subassembly in the drawn position against the tension on the bowstring; (D) placing a bolt on the slot with a nock of the bolt against the bowstring; and (E) moving the trigger to the firing trigger position, thereby moving the actuator to the firing actuator position, moving the sear to the firing sear position, permitting the catch to move to the firing catch position, releasing the bowstring, and firing the crossbow to launch the bolt.

Example 25

The method of Example 24 further comprising, after firing the crossbow: (F) moving the trigger latch to the unlatched position; and (G) letting out the rope from the spool and moving the reciprocating subassembly to the brace position.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A mechanism for drawing, cocking, and triggering a crossbow, the mechanism comprising: a stationary subassembly; a reciprocating subassembly; a winch subassembly; and a stock subassembly of the crossbow including an elongated mainframe with a longitudinal slot, wherein:

(a) the winch subassembly is mounted in the stock subassembly, the stationary subassembly is mounted on a rearward portion of the mainframe, and the reciprocating subassembly is engaged with the slot of the mainframe so as to be movable along the mainframe between a forward brace position and a rearward drawn position;

(b) the reciprocating subassembly comprises a body engaged with the slot of the mainframe, a catch, and a sear;

(c) the stationary subassembly comprises a trigger and an actuator;

(d) the winch subassembly comprises a spool, a crank handle coupled to rotate the spool, and a rope coupled to the reciprocating subassembly so that (i) rotation of the spool to take up the rope causes movement of the reciprocating subassembly in a rearward direction along the mainframe in response to tension on the rope, and (ii) rotation of the spool to let out the rope permits movement of the reciprocating subassembly in a forward direction along the mainframe; and (e) with the reciprocating subassembly in the drawn position and a bowstring of the crossbow retained by the catch, the trigger, the actuator, the sear, and the catch are arranged so that (i) movement of the trigger causes movement of the actuator, (ii) movement of the actuator causes movement of the sear, (iii) movement of the sear permits movement of the catch, and (iv) movement of the catch releases the bowstring;

(f) one or both of the stationary subassembly or the reciprocating subassembly includes a trigger latch movable between a latched position and an unlatched position and arranged so as to, (i) in the latched position and with the reciprocating subassembly in the drawn position, obstruct movement of the reciprocating subassembly from the drawn position in the forward direction, and (ii) in the unlatched position, permit movement of the reciprocating subassembly from the drawn position in the forward direction.

2. The mechanism of claim 1 wherein:

(b') the catch is movable between a firing catch position and a non-firing catch position and biased toward the firing catch position, the sear is movable between a firing sear position and a non-firing sear position and biased toward the non-firing sear position, and the catch and sear are arranged so that (i) with the catch in the non-firing catch position, the catch is arranged to retain the bowstring, (ii) with the catch in the firing catch position, the catch is arranged to release the bowstring, (iii) with the sear in the non-firing sear position, the sear is arranged to obstruct movement of the catch away from the non-firing catch position, and (iv) with the sear in the firing sear position, the sear is arranged to permit movement of the catch to the firing catch position in response to bias on the catch and thereby cause release of the bowstring;

(c') the trigger is movable between a firing trigger position and a non-firing trigger position and biased toward the non-firing trigger position, the actuator is coupled to the trigger and movable between a firing actuator position and a non-firing actuator position, and the trigger and actuator are arranged so that (i) movement, against bias on the trigger, of the trigger to the firing trigger position causes movement of the actuator to the firing actuator position, and (ii) with the reciprocating subassembly in the drawn position, movement of the actuator to the firing actuator position causes movement, against bias on the sear, of the sear to the firing sear position; and (f') the trigger latch is biased toward the latched position.

3. The mechanism of claim 2 wherein the trigger latch is arranged so as to be moved manually by a user of the crossbow to the unlatched position against bias on the trigger latch, thereby permitting movement of the reciprocating subassembly from the drawn position in the forward direction.

4. The mechanism of claim 2 wherein the trigger latch is arranged so that movement of the reciprocating subassembly to the drawn position (i) first causes movement of the trigger latch toward the unlatched position against bias on the latch, and (ii) then permits the trigger latch to move to the latched position in response to bias on the latch, thereby obstructing movement of the reciprocating subassembly from the drawn position in the forward direction.

5. The mechanism of claim 2 wherein, with the catch in the non-firing catch position retaining the bowstring, the reciprocating subassembly in the drawn position, and the trigger latch in the latched position, the trigger latch is arranged so as to hold the reciprocating subassembly in the drawn position against tension on the bowstring, independent of tension on the rope.

6. The mechanism of claim 2 wherein the crank handle is detachable from the spool.

7. The mechanism of claim 2 wherein winch subassembly further comprises a clutch arranged so that (i) with the clutch engaged, the spool can rotate only to take up the rope, and (ii) with the clutch disengaged, the spool can rotate to take up or let out the rope.

8. The mechanism of claim 7 wherein the clutch is biased toward engagement, and can be disengaged by movement against bias on the clutch.

9. The mechanism of claim 7 wherein the clutch includes a sprag clutch.

10. The mechanism of claim 7 wherein the clutch includes a ratchet and pawl.

11. The mechanism of claim 2 wherein the rope is connected directly to the reciprocating subassembly so that, with the bowstring retained by the catch, operation of the winch to move the reciprocating subassembly in the rearward direction and draw the crossbow results in force applied to the reciprocating subassembly that is about equal to tension on the rope.

12. The mechanism of claim 2 wherein the reciprocating subassembly includes a pulley, and the rope is looped around the pulley and connected directly to the stationary subassembly or the stock subassembly so that, with the bowstring retained by the catch, operation of the winch to move the reciprocating subassembly in the rearward direction and draw the crossbow results in force applied to the reciprocating subassembly that is about two times larger than tension on the rope.

13. The mechanism of claim 2 wherein the reciprocating subassembly further comprises a safety member movable between a safety-on position and a safety-off position and arranged so that (i) with the safety member in the safety-on position, the safety member obstructs movement of the sear from the non-firing sear position, and (ii) with the safety member in the safety-off position, the safety member does not obstruct movement of the sear to the firing sear position.

14. The mechanism of claim 2 wherein the reciprocating subassembly further comprises a bowstring latch movable between a bolt-present position and a bolt-absent position and biased toward the bolt-absent position, and the bowstring latch is arranged so that (i) with the bowstring latch in the bolt-absent position, the bowstring latch obstructs forward movement of the bowstring from a position rearward of the bowstring latch to a position forward of the bowstring latch, (ii) with the bowstring latch in the bolt-present position, the bowstring latch does not obstruct forward movement of the bowstring from a position rearward of the bowstring latch to a position forward of the bowstring latch, (iii) with the catch in the non-firing catch position retaining the bowstring, the reciprocating subassembly in the drawn position, and a bolt loaded onto the mainframe with a nock against the bowstring, the bolt holds the bowstring latch in the bolt-present position against bias on the bowstring latch, and (iv) with no bolt loaded onto the mainframe, the bowstring latch is held in the bolt-absent position by the bias on the bowstring latch.

15. The mechanism of claim 2 wherein the sear and the mainframe are arranged so that (i) with the reciprocating subassembly at intermediate positions along the mainframe, the mainframe blocks movement of the sear to the firing sear position, and (ii) with the reciprocating subassembly in the brace position or the drawn position, the mainframe does not obstruct movement of the sear to the firing sear position.

16. The mechanism of claim 2 wherein the catch includes a roller that engages the sear.

17. The mechanism of claim 2 wherein the actuator includes a roller that engages the sear.

18. The mechanism of claim 2 wherein the trigger and the actuator are arranged so that (i) with the reciprocating subassembly in the drawn position and the trigger held by the bias on the trigger in the non-firing trigger position, the actuator does not make contact with the sear, and (ii) with the reciprocating subassembly in the drawn position, movement of the trigger from the non-firing trigger position to the firing trigger position first causes the actuator to make contact with the sear and then causes the actuator to move the sear to the firing sear position.

19. A crossbow incorporating the mechanism of claim 2, the crossbow further comprising: a pair of bow limbs connected to a forward portion of the mainframe and disposed on opposite sides of the mainframe; and a bowstring connected to ends of the bow limbs.

20. The crossbow of claim 19 wherein the bow limbs are connected directly to the forward portion of the mainframe.

21. The crossbow of claim 19 further comprising a riser connected directly to the forward portion of the mainframe, wherein the bow limbs are connected to the riser.

22. The crossbow of claim 19 wherein the bow limbs are arranged so that the crossbow is arranged as a recurve crossbow.

23. The crossbow of claim 19 further comprising a pair of pulley members and one or more cables coupled to one or both pulley members or to the mainframe or to a riser, wherein each pulley member is rotatably mounted on a corresponding one of the bow limbs, and the bowstring and the one or more cables are each engaged with one or both pulley members so that the crossbow is arranged as a compound crossbow.

24. A method for using the crossbow of claim 19, the method comprising:

(A) with the reciprocating subassembly in the brace position, moving the catch to the non-firing catch position to retain the bowstring;

(B) using the crank handle, rotating the spool to take up the rope and move the reciprocating subassembly to the drawn position against tension on the bowstring, thus drawing the crossbow;

(C) with the trigger latch in the latched position, holding the reciprocating subassembly in the drawn position against the tension on the bowstring;

(D) placing a bolt on the slot with a nock of the bolt against the bowstring; and (E) moving the trigger to the firing trigger position, thereby moving the actuator to the firing actuator position, moving the sear to the firing sear position, permitting the catch to move to the firing catch position, releasing the bowstring, and firing the crossbow to launch the bolt.

25. The method of claim 24 further comprising, after firing the crossbow:

(F) moving the trigger latch to the unlatched position; and (G) letting out the rope from the spool and moving the reciprocating subassembly to the brace position.

* * * * *